US007219907B2

(12) United States Patent
Chang

(10) Patent No.: US 7,219,907 B2
(45) Date of Patent: May 22, 2007

(54) SKATEBOARD WHEEL SET WITH SUSPENSION DEVICE

(76) Inventor: Chuck Chang, No. 176-3, Guangming Rd., Taichung 407 (TW)

( * ) Notice: Subject to any disclaimer, the term of this patent is extended or adjusted under 35 U.S.C. 154(b) by 260 days.

(21) Appl. No.: 10/934,448

(22) Filed: Sep. 7, 2004

(65) Prior Publication Data

US 2005/0093262 A1 May 5, 2005

Related U.S. Application Data

(63) Continuation-in-part of application No. 10/612,907, filed on Jul. 7, 2003, now Pat. No. 6,913,272.

(51) Int. Cl.
*B62M 1/00* (2006.01)
*A63C 17/02* (2006.01)
*A63C 17/00* (2006.01)

(52) U.S. Cl. ..... 280/87.042; 280/87.041; 280/11.27; 280/11.225; 280/11.28

(58) Field of Classification Search ..... 280/11.27, 280/11.225, 11.28, 87.041, 87.042
See application file for complete search history.

(56) References Cited

U.S. PATENT DOCUMENTS 4,176,850 A * 12/1979 Johnson ..... 280/87.042
5,263,725 A * 11/1993 Gesmer et al. ..... 280/11.28
5,868,408 A * 2/1999 Miller ..... 280/87.042
6,299,186 B1 * 10/2001 Kao et al. ..... 280/87.041
6,318,739 B1 * 11/2001 Fehn, Jr. ..... 280/11.28
6,474,666 B1 * 11/2002 Andersen et al. ..... 280/87.041
6,659,480 B1 * 12/2003 Newman ..... 280/87.042
2002/0011713 A1 * 1/2002 Kirkland ..... 280/11.28
2004/0100053 A1 * 5/2004 Chen ..... 280/87.041

* cited by examiner

*Primary Examiner*—Christopher P. Ellis
*Assistant Examiner*—John R. Olszewski
(74) *Attorney, Agent, or Firm*—Rosenberg, Klein & Lee

(57) ABSTRACT

A skateboard includes a deck with two connection members connected to an underside thereof the deck and two trucks are connected to the two connection members respectively. Each truck has a main body and a transverse tube, and two wheels are rotatably connected to two wheel frames connected to two ends of the transverse tube. A truck spring member is received in each main body and has a first recess with which a protrusion on each connection member is engaged. The truck is rotatable about a first pin extending through the main body and the truck spring members, and is connected to the connection member.

7 Claims, 11 Drawing Sheets

SKATEBOARD WHEEL SET WITH SUSPENSION DEVICE

FIELD OF THE INVENTION

This is a Continuation-In-Part application of applicant's former patent application Ser. No. 10/612,907, file on Jul. 7, 2003 now U.S. Pat. No. 6,913,272.

BACKGROUND OF THE INVENTION

A conventional skateboard generally includes a deck and two trucks that are connected to the underside of the deck. Each truck has two wheels connected to two ends of the truck and is cooperated with two respective bearings. However, there is no sufficient suspension device connected between the wheels and the trucks so that the wheels do not accurately response to the movement of the skateboard and it is experienced that the wheels could interfere with each other. Eventually, the players cannot maintain balance during severe changes of movements when playing the skateboard.

The present invention intends to provide a skateboard wherein each set of the wheel sets on the bottom of the deck includes two independent suspension devices so as to provide suspension features in different directions.

SUMMARY OF THE INVENTION

The present invention relates to a skateboard that comprises a deck with two connection members connected to an underside thereof and two trucks are connected to the two connection members respectively. Each truck has a main body connected to the connection member and a transverse tube to which two wheel frames are connected to two ends thereof. Two wheels are rotatably connected to the two wheel frames. A truck spring member is received in each main body and has a first recess. Each connection member has a protrusion which is engaged with the first recess so that the truck is rotatable about a first pin extending through the main body, the truck spring member and connected to the connection member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
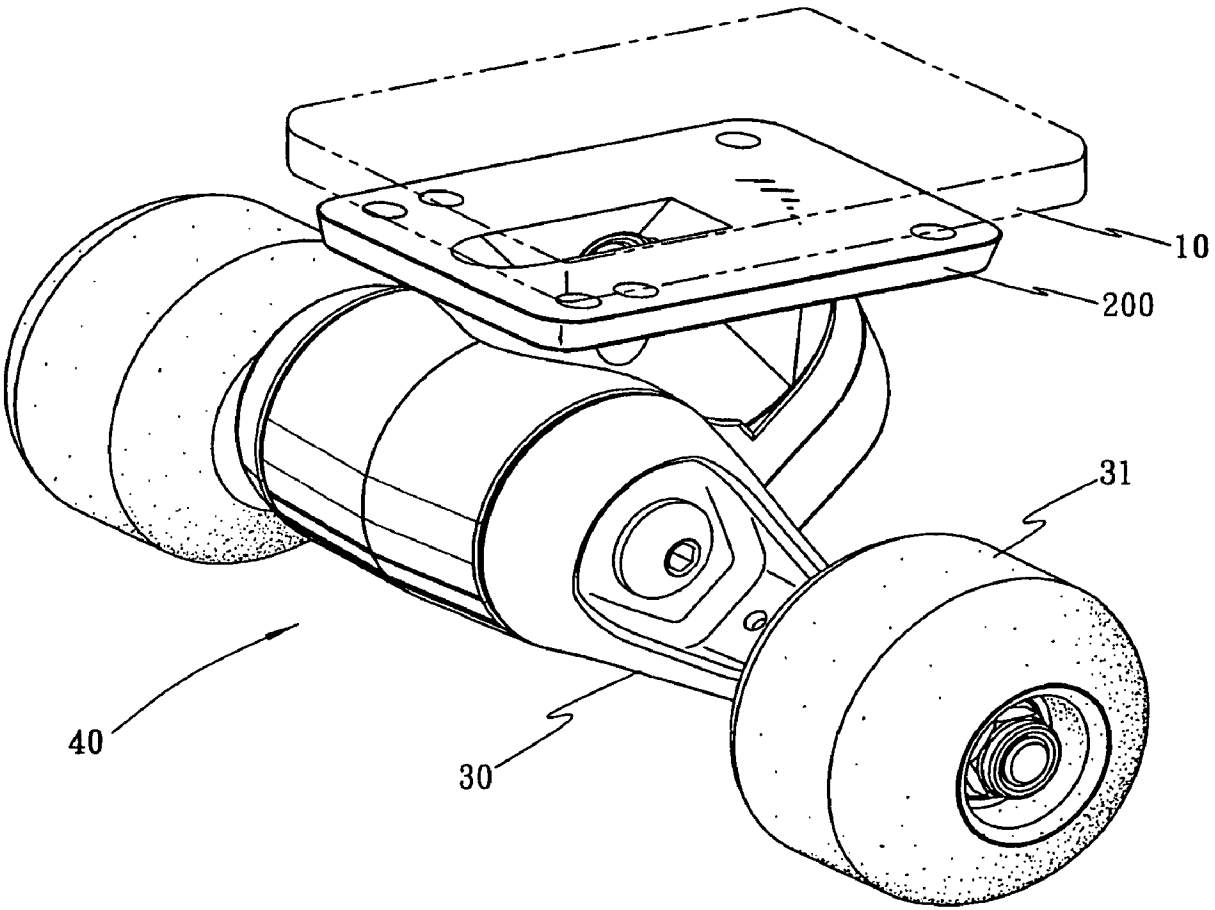
FIG. 1 is a perspective view to show one set of the connection member, the truck and the wheel frames of the present invention.
Figure 2:
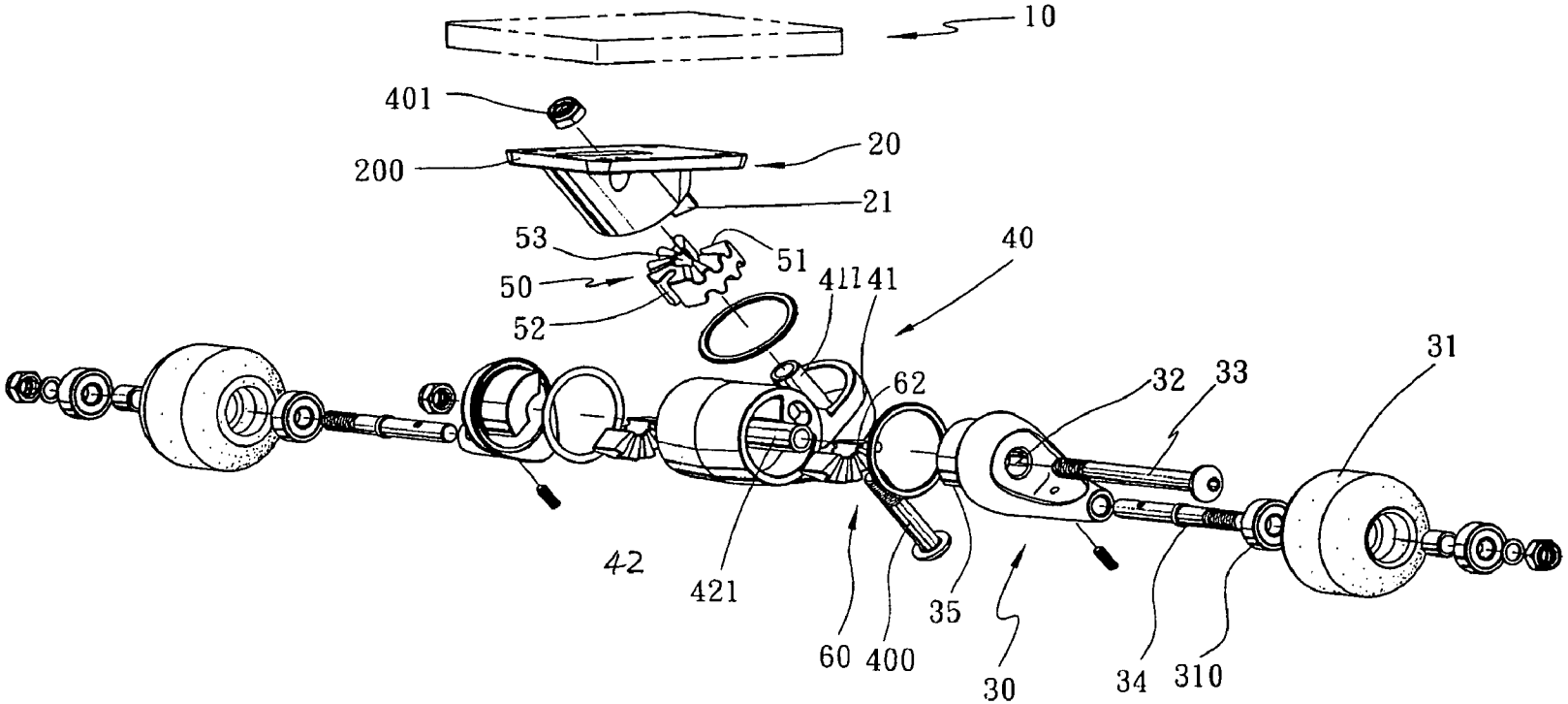
FIG. 2 is an exploded view to show one set of the connection member, the truck and the wheel frames of the present invention.

Referring to FIGS. 1 to 6 and 8, the skateboard of the present invention comprises a deck 10 and two connection members 20 each have a board 200 which is connected to an underside of the deck 10. Two trucks 40 are connected to the two connection members 20 respectively and each truck 40 includes a main body 41 for connecting with the connection member 20 and a transverse tube 42 for connecting two wheel frames 30 on two ends thereof. A truck spring member 50 is received in each main body 41 and has a first recess 51 and a second recess 52 defined radially therein respectively. A first pin 400 extends through a durable tube 411 in the main body 41 and a hole 53 in the truck spring member 50 and is connected to a nut 401 received in the connection member 20. Each connection member 20 has a protrusion 21 which is inserted in the main body 41 and engaged with the first recess 51. The main body 41 further has a ridge 43 (FIG. 3) extending from an inner periphery thereof and engaged with the second recess 52 to position the truck spring member 50.

Each wheel frame 30 has a central hole 32 and a second pin 33 extends through two respective central holes 32 in the two wheel frames 30 and the transverse tube 42. Each wheel frame 30 has a wheel shaft 34 eccentrically extending therethrough and two wheels 31 and bearings 310 are rotatably connected to the wheel shafts 34 on the two wheel frames 30 respectively.

Figure 7:
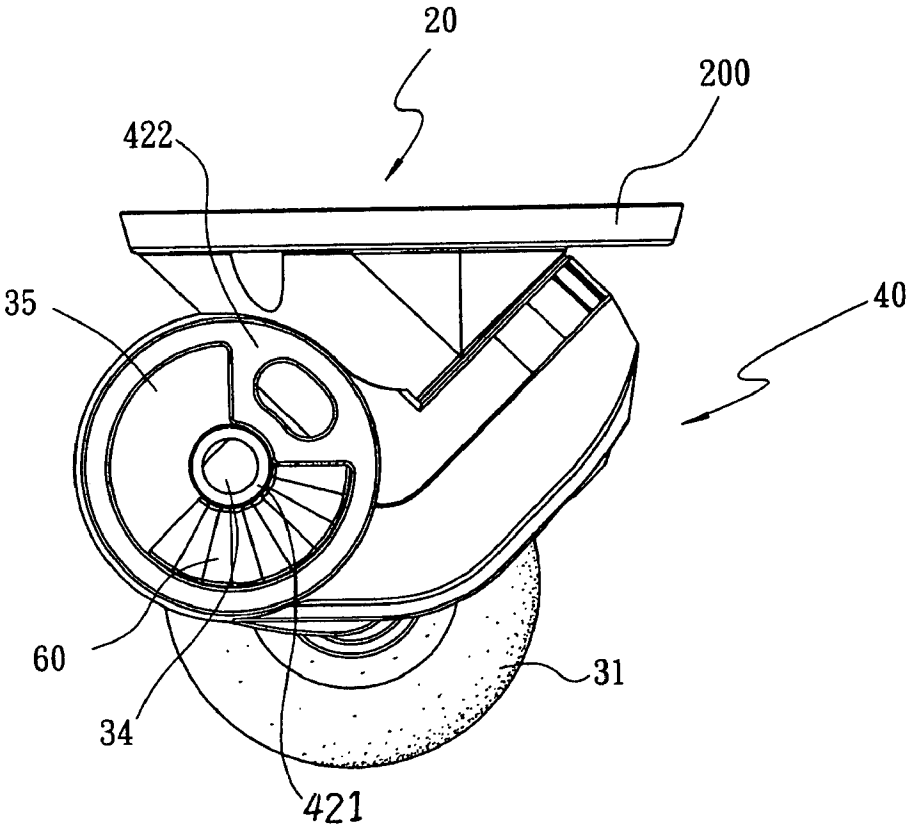
FIG. 7 shows the frame spring member in the transverse tube of the truck and an insertion on the wheel frame may compress the frame spring member.
Figure 8:
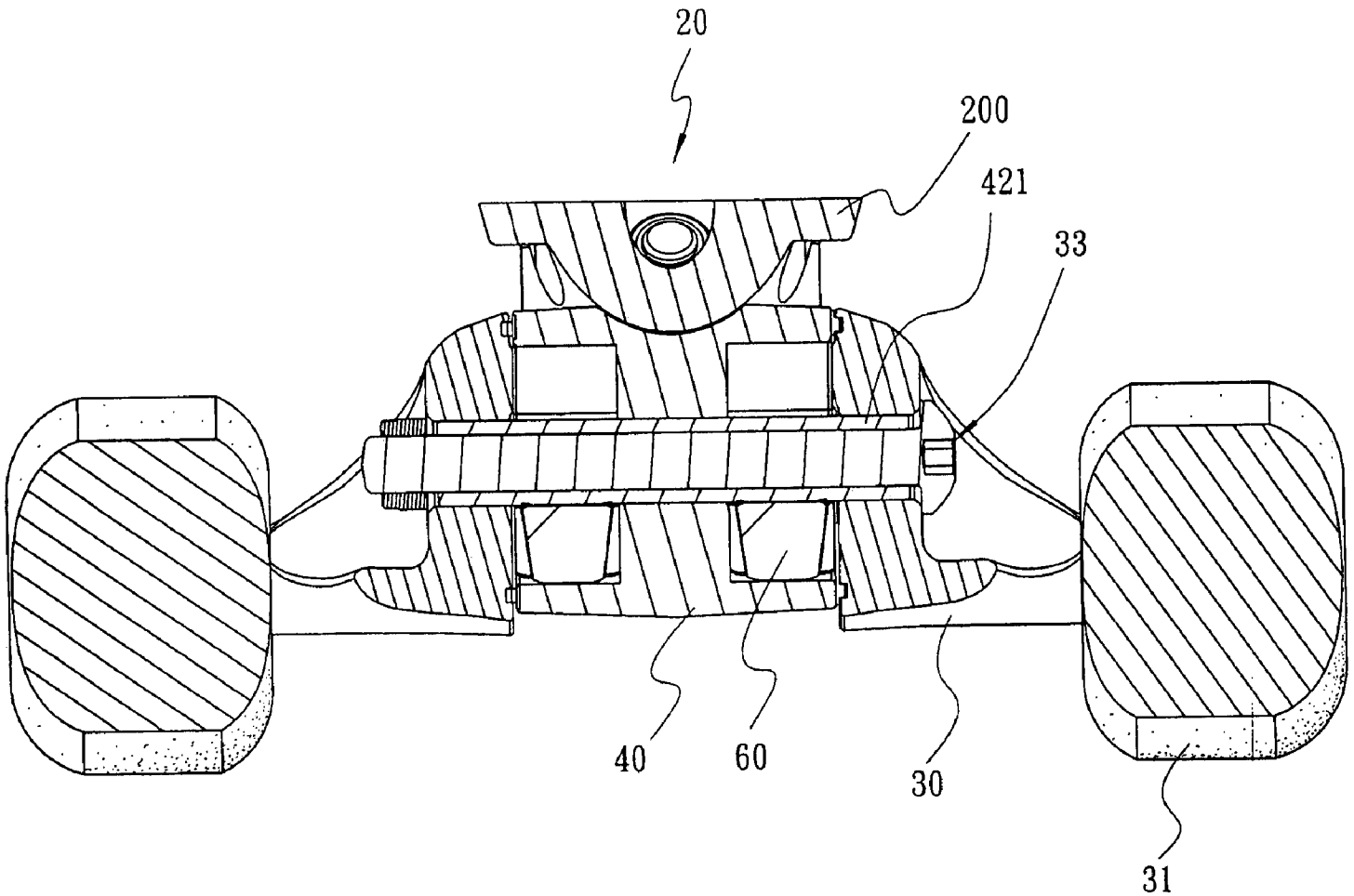
FIG. 8 is a front cross sectional view to show the connection member, the truck and the wheel frames of the present invention.

Further referring to FIG. 7, a frame spring member 60 is located between each of the wheel frames 30 and the transverse tube 42. Each wheel frame 30 has an insertion 35 which is inserted in the transverse tube 42. The transverse tube 42 includes a central tube 421 through which the second pin 33 extends. A connection portion 422 extends from an inner periphery of the transverse tube 42 and is connected to the central tube 421. The frame spring member 60 has one side contacting the connection portion 422 and the other side of the frame spring member 60 is in contact with the insertion 35.

Figure 3:
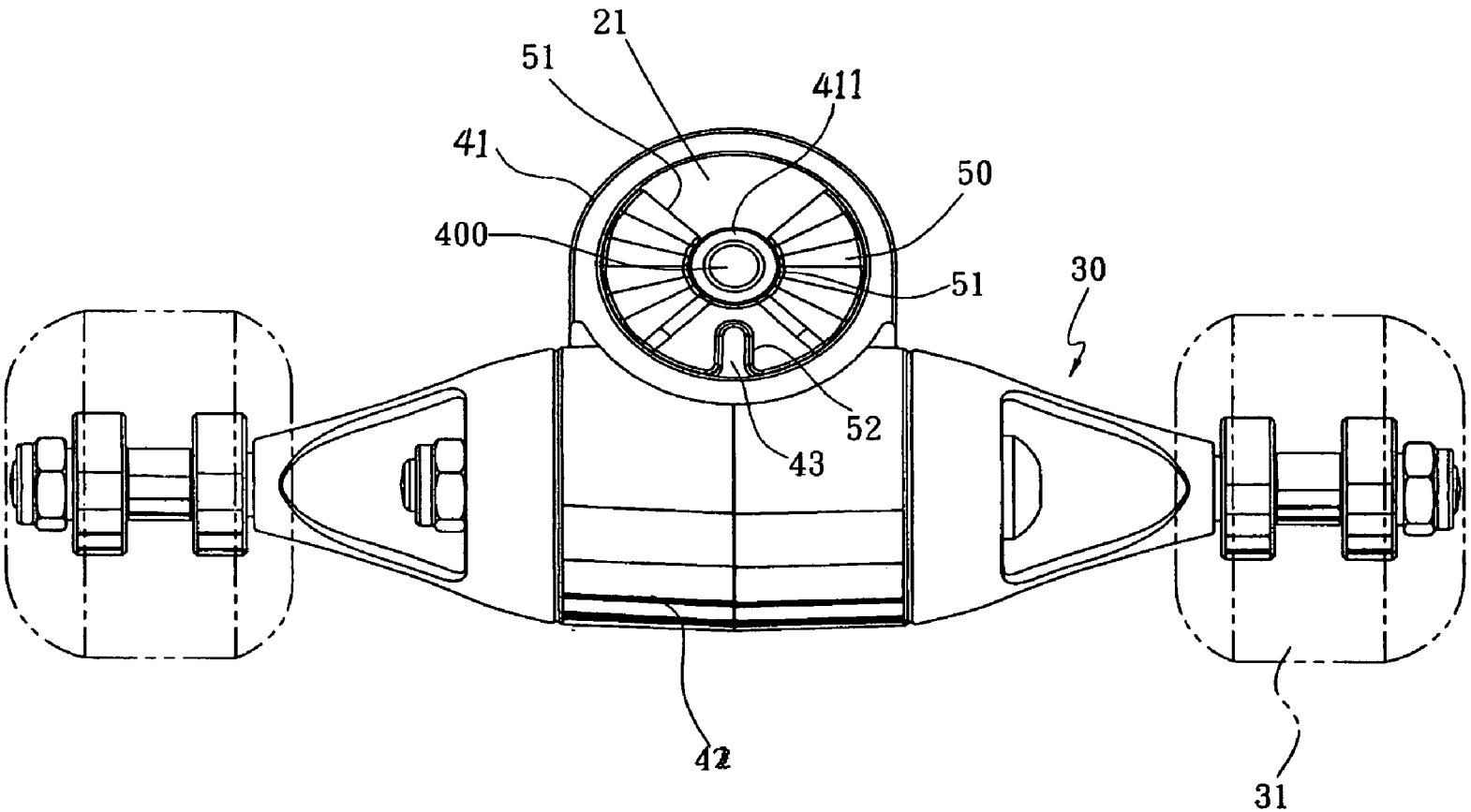
FIG. 3 is a front view to show the truck spring member and the protrusion of the connection member.
Figure 4:
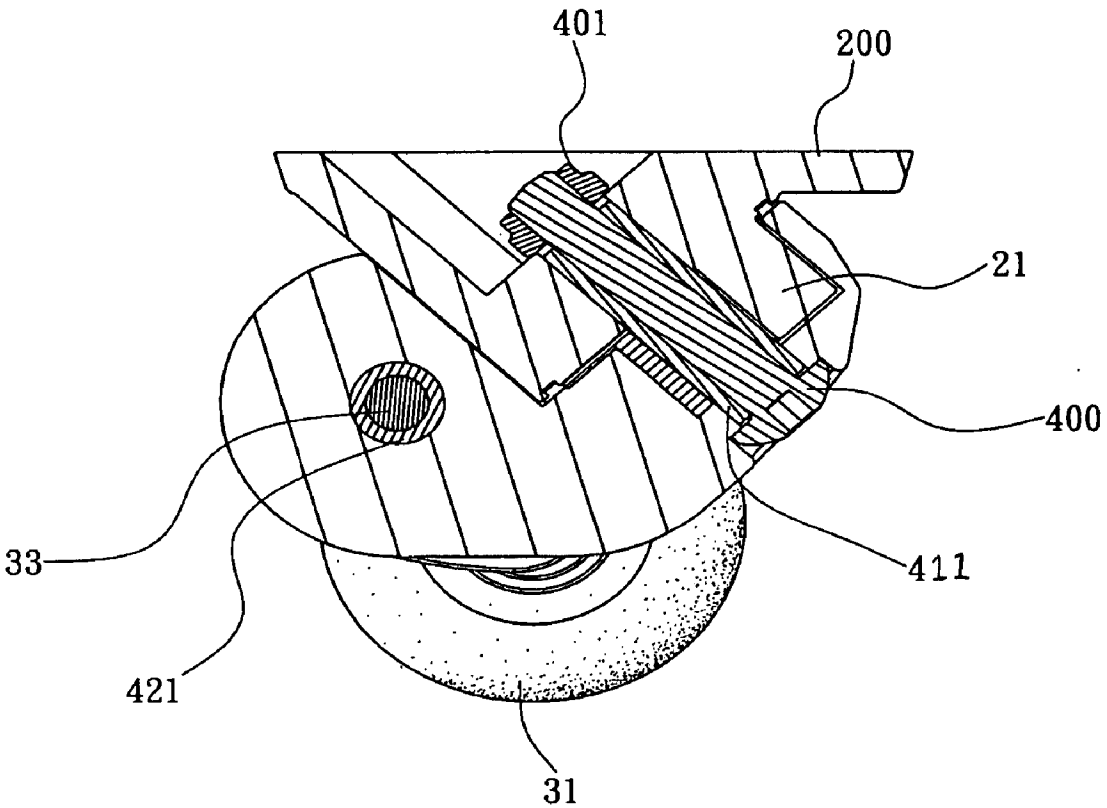
FIG. 4 shows a side cross sectional view of the first pin connecting the connection member and the truck.
Figure 5:
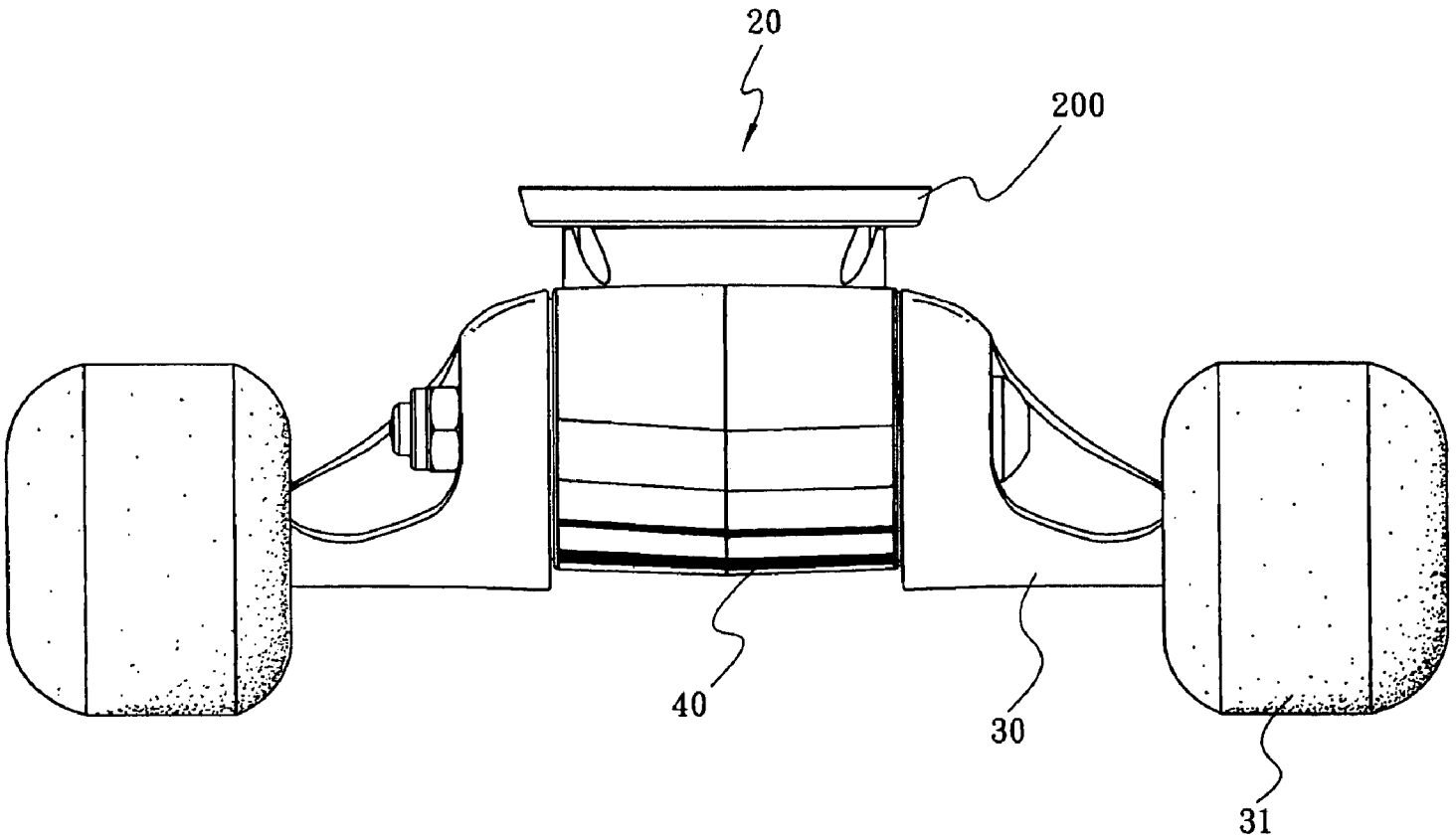
FIG. 5 shows the wheel frames connected to the truck.
Figure 6:
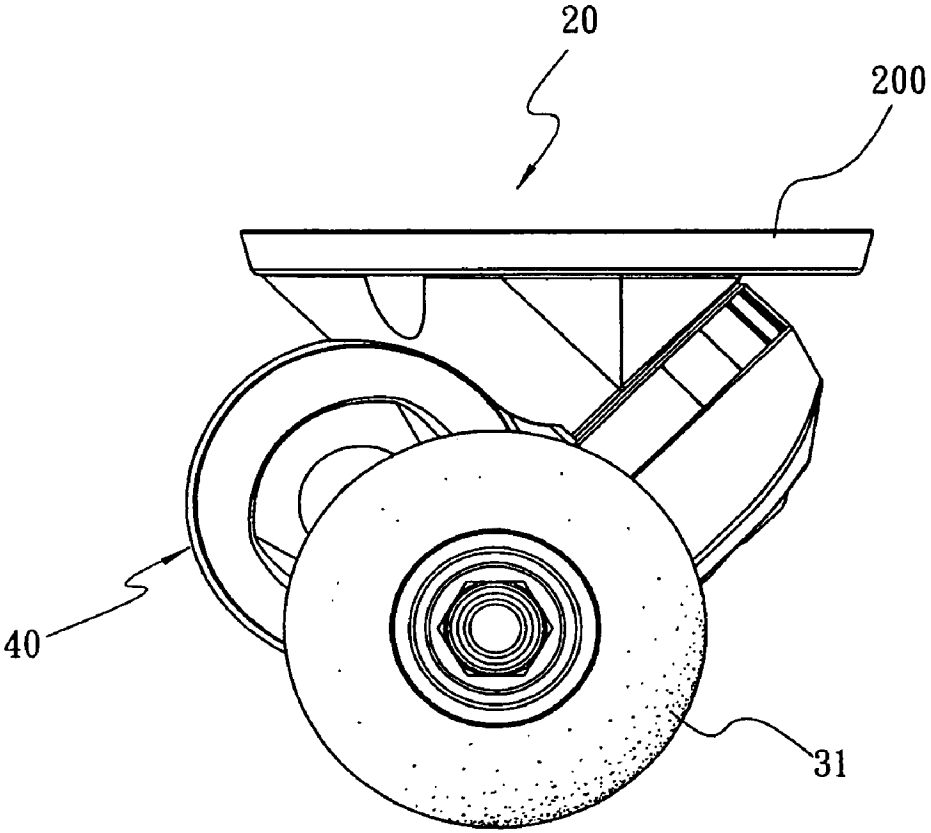
FIG. 6 is a side view to show the wheel on the wheel frame and the truck.

Referring to FIGS. 3 and 4, the truck 40 can be rotatable about the first pin 400 and the truck spring member 50 is compressed by the protrusion 21 on either side and provides a bouncing force to re-position the truck 40.

The wheel frame 30 is rotatable about the second pin 33 and the frame spring member 60 provides a force to re-position the wheel frame 30. The wheels 31 are located eccentrically on the wheel frame 30 and is allowed to move in vertical and horizontal directions relative to the truck 40.

The present invention provides a simple and efficient mechanism to let the wheel frames 30 automatically adjust their positions during playing the skateboard.

Figure 9:
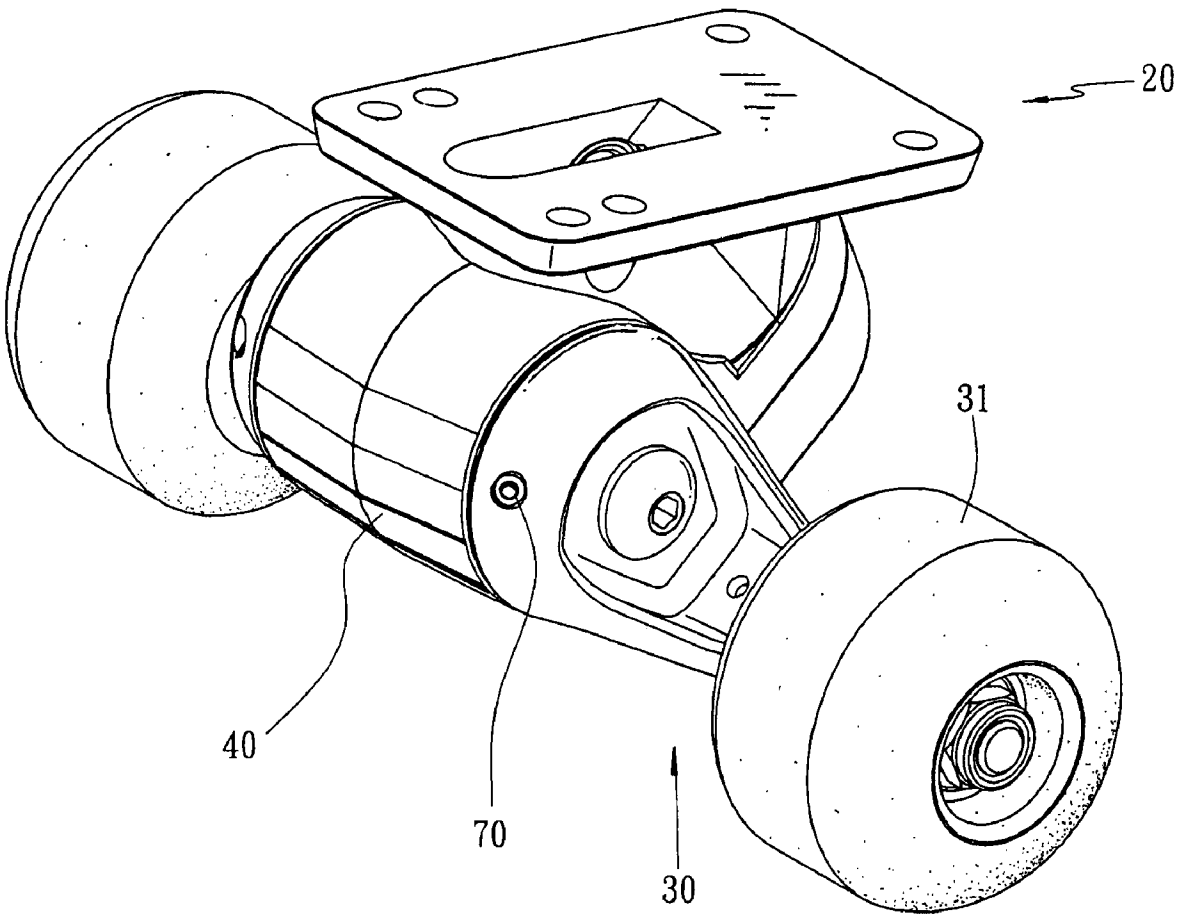
FIG. 9 is a perspective view to show another embodiment of assembly of the connection member, the truck and the wheel frames of the present invention.
Figure 10:
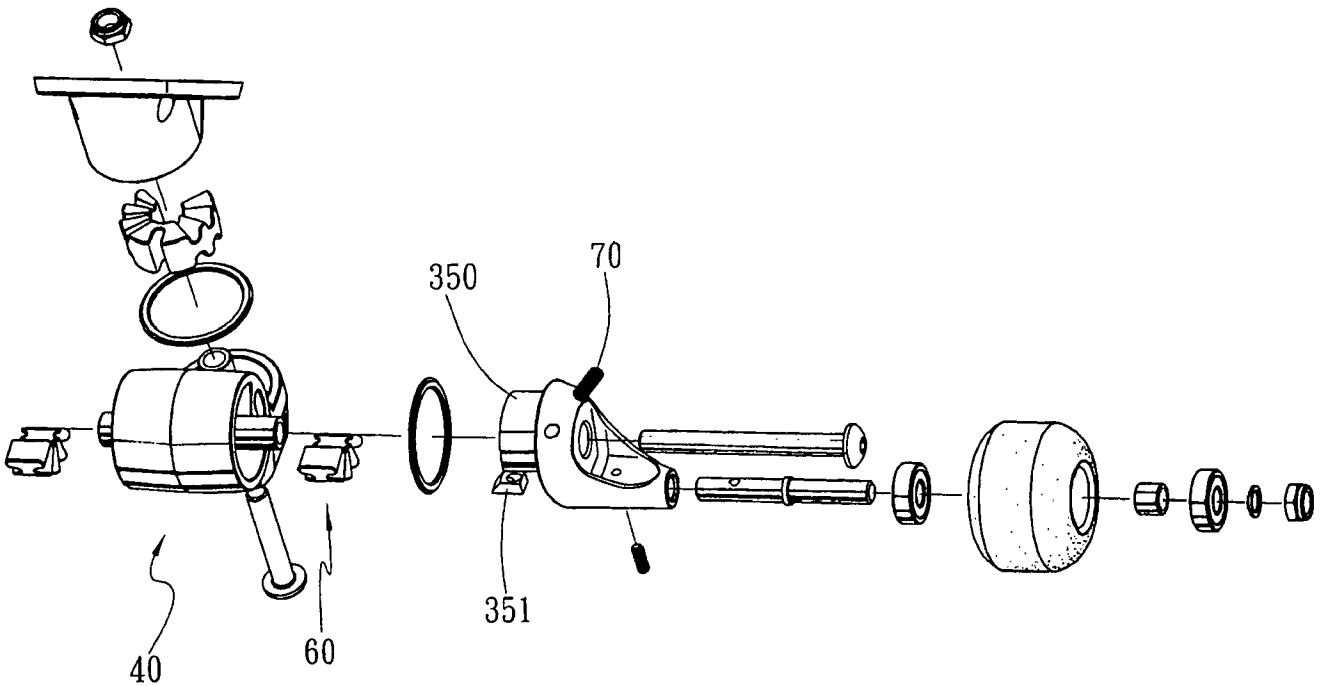
FIG. 10 is an exploded view of the embodiment in FIG. 9.
Figure 11:
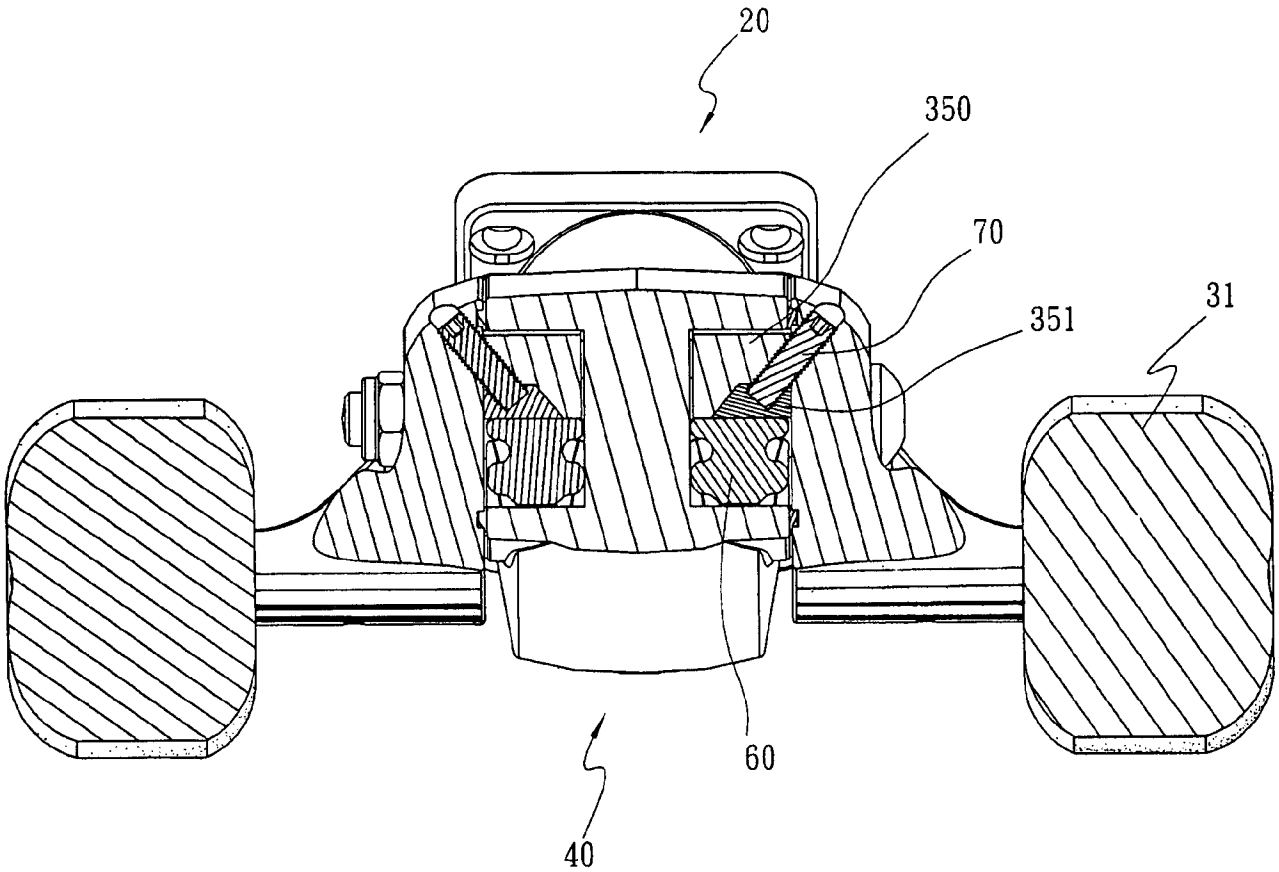
FIG. 11 is a cross sectional view to show the embodiment in FIG. 9.

FIGS. 9 to 11 show another embodiment of the present invention, wherein each insertion 350 has a contact member 351 which is in contact with the frame spring member 60. Two adjusting bolts 70 are respectively inserted into the two wheel frames 30 and press the two respective contact members 351. By rotating the two adjusting bolts 70, the bouncing force of the wheel frames 30 can be adjusted.

While we have shown and described the embodiment in accordance with the present invention, it should be clear to those skilled in the art that further embodiments may be made without departing from the scope of the present invention.

What is claimed is:

1. A skateboard comprising:

a deck (10);

two connection members (20) connected to an underside of the deck (10) and two trucks (40) connected to the two connection members (20) respectively, each truck (40) having a main body (41) and a transverse tube (42), each main body (41) having a ridge (43) extending from an inner periphery thereof, two wheel frames (30) connected to two ends of the transverse tube (42) and two wheels (31) rotatably connected to the two wheel frames (30), and a truck spring member (50) received in each main body (41) and having a first recess (51) defined radially therein, each connection member (20) having a protrusion (21) which is engaged with the first recess (51) so that the truck (40) is rotatable about a first pin (400) which extends through the main body (41) and the truck spring member (50), and is connected to the connection member (20), the truck spring member (50) including a second recess (52) defined radially therein with which the ridge (43) is engaged.

2. The skateboard as claimed in claim 1, wherein each wheel frame (30) has a central hole (32) and a second pin (33) extends through two respective central holes (32) in the two wheel frames (30) and the transverse tube (42), each wheel frame (30) has a wheel shaft (34) eccentrically extending therethrough, a frame spring member (60) is located between each of the wheel frames (30) and the transverse tube (42), each wheel frame (30) has an insertion (35) which is in contact with one of two sides of the frame spring member (60).

3. The skateboard as claimed in claim 2, wherein the transverse tube (42) includes a central tube (421) through which the second pin (33) extends, a connection portion (422) extends from an inner periphery of the transverse tube (42) and is connected to the central tube (421), the frame spring member (60) has one side contacting the connection portion (422) and the other side is in contact with the insertion (35).

4. The skateboard as claimed in claim 2, wherein each insertion (350) has a contact member (351) which is in contact with the frame spring member (60), two adjusting bolts (70) respectively inserted into the two wheel frames (30) and pressing the two respective contact members (351).

5. A skateboard comprising:

a deck (10);

two connection members (20) connected to an underside of the deck (10) and two trucks (40) connected to the two connection members (20) respectively, each truck (40) having a main body (41) and a transverse tube (42), two wheel frames (30) connected to two ends of the transverse tube (42) and two wheels (31) rotatably connected to the two wheel frames (30), each wheel frame (30) having a central hole (32) and a second pin (33) extends through two respective central holes (32) in the two wheel frames (30) and the transverse tube (42), each wheel frame (30) having a wheel shaft (34) eccentrically extending therethrough, the transverse tube (42) including a central tube (421) through which the second pin (33) extends, a connection portion (422) extending from an inner periphery of the transverse tube (42) and being connected to the central tube (421), and a frame spring member (60) is located between each of the wheel frames (30) and the transverse tube (42), the frame spring member (60) having one side contacting the connection portion (422) and the other side being in contact with an insertion (350) which is connected to each wheel frame (30) each insertion (350) having a contact member (351) which is in contact with the frame spring member (60), two adjusting bolts (70) respectively inserted into the two wheel frames (30) and pressing the two respective contact members (351).

6. The skateboard as claimed in claim 5, wherein a truck spring member (50) is received in each main body (41) and has a first recess (51) defined radially, each connection member (20) has a protrusion (21) which is engaged with the first recess (51) so that the truck (40) is rotatable about a first pin (400) extending through the main body (41) and the truck spring member (50) and is connected to the connection member (20).

7. The skateboard as claimed in claim 6, wherein the main body (41) has a ridge (43) extending from an inner periphery thereof and the truck spring member (50) includes a second recess (52) defined radially with which the ridge (43) is engaged.

* * * * *